US010530091B2

(12) United States Patent
Jansen et al.

(10) Patent No.: US 10,530,091 B2
(45) Date of Patent: Jan. 7, 2020

(54) WATER-TIGHT PARTITION WALL BUSHING FOR PLUG CONNECTORS

(71) Applicant: STOCKO Contact GmbH & Co. KG, Wuppertal (DE)

(72) Inventors: Stephan Jansen, Hellenthal (DE); Ehrenfried Günther, Hellenthal (DE); Ralf Hennes, Hellenthal (DE)

(73) Assignee: STOCKO CONTACT GmbH & CO. KG (DE)

( * ) Notice: Subject to any disclaimer, the term of this patent is extended or adjusted under 35 U.S.C. 154(b) by 0 days.

(21) Appl. No.: 16/085,008

(22) PCT Filed: Mar. 14, 2017

(86) PCT No.: PCT/EP2017/056026
§ 371 (c)(1),
(2) Date: Sep. 14, 2018

(87) PCT Pub. No.: WO2017/157957
PCT Pub. Date: Sep. 21, 2017

(65) Prior Publication Data

US 2019/0081434 A1 Mar. 14, 2019

(30) Foreign Application Priority Data

Mar. 15, 2016 (DE) ..... 10 2016 204 230

(51) Int. Cl.
*H01R 13/73* (2006.01)
*H01R 13/52* (2006.01)
*H01R 13/74* (2006.01)

(52) U.S. Cl.
CPC ..... *H01R 13/5202* (2013.01); *H01R 13/521* (2013.01); *H01R 13/743* (2013.01); *H01R 13/5216* (2013.01)

(58) Field of Classification Search
CPC .. H01R 13/5202; H01R 13/62; H01R 13/516; H01R 13/745; H01R 13/743; H01R 13/521; H02G 3/121
See application file for complete search history.

(56) References Cited

U.S. PATENT DOCUMENTS 5,249,982 A 10/1993 Funck et al.
5,807,125 A * 9/1998 Edgley ..... H01R 13/743 439/248

(Continued)

FOREIGN PATENT DOCUMENTS

CN 102870289 A 1/2013
CN 204538368 U 8/2015

(Continued)

OTHER PUBLICATIONS

International Search Report Corresponding to European Application No. PCT/EP2017/056026, dated May 29, 2018.

(Continued)

*Primary Examiner* — Jean F Duverne
(74) *Attorney, Agent, or Firm* — Tarolli, Sundheim, Covell & Tummino LLP

(57) ABSTRACT

The invention relates to a plug connector part that can be inserted into a bushing of a partition wall. A plug connector part according to the invention can be connected to a mating part and can be inserted into a recess in a partition wall, whereby the plug connector part has a base with a collar, that projects beyond the surface of the recess in the partition wall, and said plug connector part is characterized in that, on the side of the collar facing the partition wall, there is a first sealing element in the form of an encircling sealing lip, that is arranged in such a way that it rests on the partition wall when the plug connector part is inserted into the recess of the (Continued)

Figure 1:
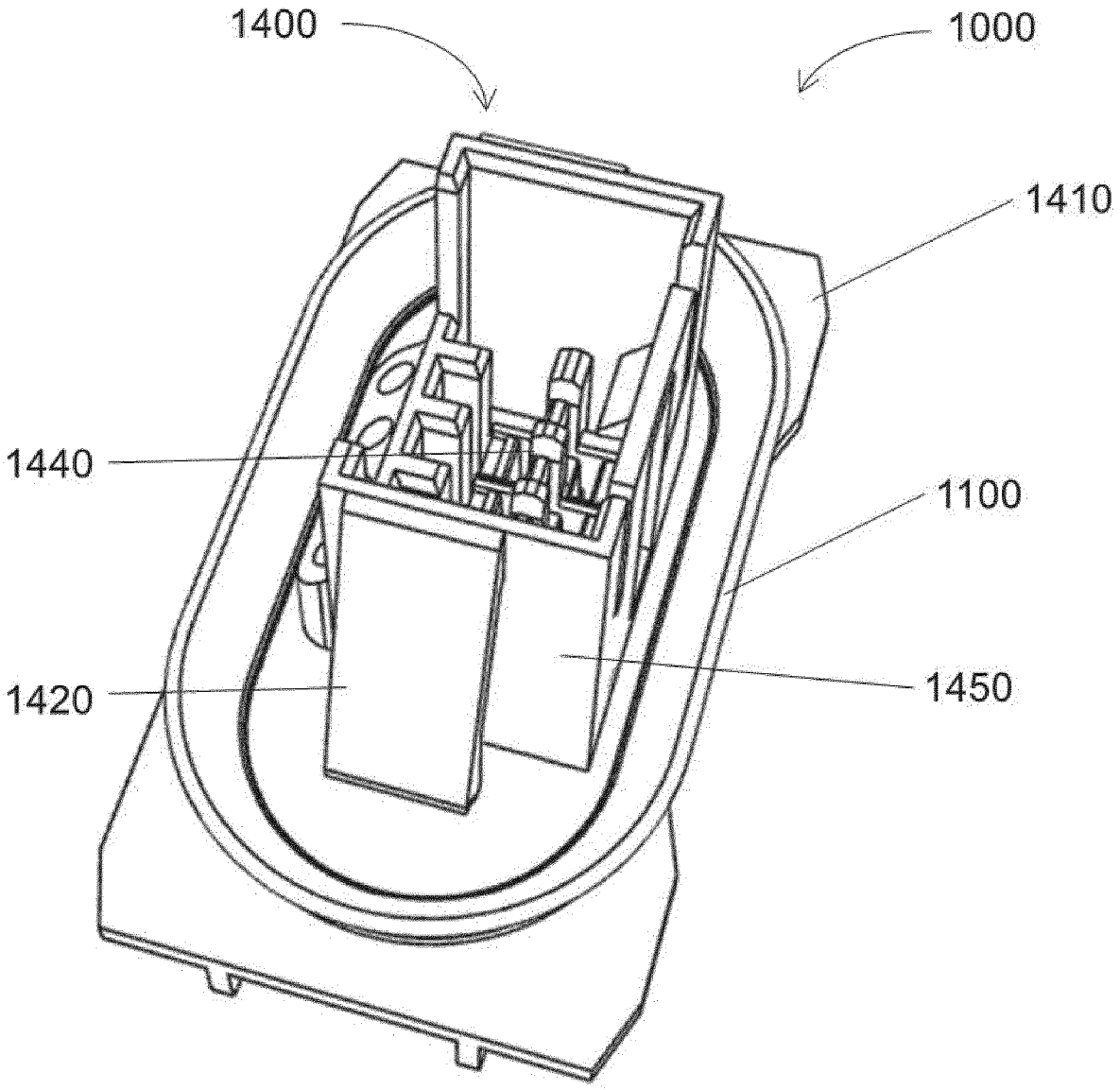

partition wall, whereby the plug connector part also has a second sealing element in the form of a cable entry seal.

4 Claims, 7 Drawing Sheets

(56) References Cited

U.S. PATENT DOCUMENTS 6,254,428 B1 * 7/2001 Murakami ..... H01R 13/5202 439/556
6,848,938 B2 * 2/2005 Miyamoto ..... H01R 13/743 439/556
6,860,759 B2 * 3/2005 Nakamura ..... H01R 13/745 439/557
7,182,637 B2 * 2/2007 Coyle, Jr. ..... H01R 13/743 439/281
7,338,317 B1 * 3/2008 Nagy ..... H01R 13/745 439/555
8,932,071 B2 * 1/2015 Venema ..... H01R 13/62 439/248
9,071,007 B2 * 6/2015 Muro ..... H01R 13/5202
9,130,298 B1 * 9/2015 Baydoun ..... H01R 13/516
9,774,129 B2 * 9/2017 Kikuchi ..... H01R 13/5202
10,090,615 B1 * 10/2018 Yi ..... H02G 3/121

FOREIGN PATENT DOCUMENTS

DE 4002903 A1 8/1991
JP S5855378 U 4/1983

OTHER PUBLICATIONS

International Search Report for corresponding International Application No. PCT/EP2017/056026 dated Apr. 26, 2017.

* cited by examiner

WATER-TIGHT PARTITION WALL BUSHING FOR PLUG CONNECTORS

RELATED APPLICATIONS

The present invention is a U.S. National Stage under 35 USC 371 patent application, claiming priority to Serial No. PCT/EP2017/056026, filed on 14 Mar. 2017; which claims priority of DE 10 2016 204 230.0, filed on 15 Mar. 2016, the entirety of both of which are incorporated herein by reference.

The invention relates to a plug connector part that can be inserted into a bushing of a partition wall.

Such plug connectors for connecting electric lines are known and commercially available from many manufacturers. Plug connectors serve to connect and disconnect lines used for technical media such as electric current or, for instance, also optical radiation. In this context, the connecting parts are oriented so as to fit by virtue of the positive locking of the plug parts and are detachably affixed non-positively, for example, by elastic force.

Plug connectors are also employed, for instance, to connect electric lines between an interior space and the surroundings of insulated spaces. In one application case involving a refrigerator, an intermediate space between an inner partition wall and an outer partition wall is insulated with insulating material. This insulating material can be, for example, polyurethane foam (PU foam). While this PU foam is in the liquid state, it is sprayed into the intermediate space between the partition walls and it then fully reacts, thereby expanding. In this process, part of the plug connectors that had been inserted into a recess in one of the partition walls is wetted with and encapsulated by the PU foam on one side, namely, the rear opposite from the insertion side. Here, the recess in the partition wall is dimensioned in such a way that the plug connector part can be inserted into the recess with a certain amount of play. Since the polyurethane is relatively liquid prior to expanding, the risk exists that it might run into the plug connector part and/or that it might flow past the plug connector part all the way through the recess in the partition wall. In order to prevent this, the plug connectors are usually sealed off manually on one side with silicone, adhesive tape or the like before the PU foam is added. This manual work step is very laborious and does not always yield the desired result, that is to say, it can happen that, in spite of this manual sealing procedure, PU foam flows into the plug connector or else past the plug connector all the way through the bushing of the partition wall. In this context, it can also happen that the PU foam, once it has fully reacted, passes through the plug connector, which gives rise not only to a visual flaw but also no longer allows a mating piece of the plug connector to be inserted into the plug connector part that has been inserted into the partition wall, or else causes the electric contact inside the plug connector to be defective.

The objective of the invention is to put forward a plug connector part which can be inserted into a recess in a partition wall and which, while entailing less assembly effort in comparison to the state of the art, minimizes the amount of insulating material passing through the plug connector part as well as the amount of insulating material passing through the partition wall and past the plug connector part. It is also an objective of the invention to put forward a method for the production of such a plug connector part.

This objective is achieved according to the invention by means of a plug connector part having the features of the independent claim 1. Advantageous refinements of the plug connector part ensue from the subordinate claims 2 to 9. The objective is also achieved by means of a method according to claim 10.

A plug connector part according to the invention can be connected to a mating part and can be inserted into a recess in a partition wall, whereby the plug connector part has a base with a collar, whereby the collar projects beyond the surface of the recess in the partition wall, and it is characterized in that, on the side of the collar facing the partition wall, there is a first sealing element in the form of an encircling sealing lip, whereby the sealing lip is arranged in such a way that it rests on the partition wall when the plug connector part is inserted into the recess of the partition wall, whereby the plug connector part also has a second sealing element in the form of a cable entry seal. The base can be affixed in the partition wall bushing. This can be done, for example, by means of latching tabs that are provided on the base and that are configured in such a way that they latch into or behind the partition wall. This fixation modality causes the plug connector part to be latched in the partition wall in such a way that the first sealing element in the form of the encircling sealing lip is pressed against the partition wall. Due to the pressure exerted by the fixation, the sealing lip is deformed and it seals off the collar vis-à-vis the partition wall.

In this manner, no insulating material, for example, polyurethane, can penetrate past the plug connector part into the recess in the partition wall. Moreover, the plug connector part has a second sealing element in the form of a cable entry seal. This sealing element seals off a cable that has been inserted into the plug connector part vis-à-vis said plug connector part so that likewise no insulating material, for instance, polyurethane, can penetrate past the cable into the plug connector part or even penetrate all the way through the plug connector part.

In an advantageous embodiment, the first sealing element and the second sealing element are integrally bonded to each other. As a result, both of the sealing elements can be applied in one work step, thus minimizing the assembly effort.

In another advantageous embodiment, the plug connector part also has a bushing for an insulation-displacement contact (IDC), whereby the plug connector part has a third sealing element in the form of a bushing seal. Insulation-displacement contacts are very often employed in plug connectors in order to establish a fast and effortless contact with inserted cables. Insulation-displacement contacts are normally affixed in the plug connector part and they can require wall bushings through the plug connector part. The third sealing element seals off such a wall bushing through the base vis-à-vis the surroundings, so that here too, no insulating material such as, for instance, polyurethane can penetrate into the plug connector part.

It has proven to be advantageous for the third sealing element to be integrally bonded to the first and second sealing elements. As a result, the sealing elements can be applied in a single work step, thus minimizing the assembly effort.

In an especially advantageous embodiment, the first sealing element has an encircling sealing lip with a foot area and a lip area, whereby the lip area has the cross section of a column that slants away from the center of the plug connector part, whereby the foot area has a rectangular cross section and the wall of the lip area is thinner than that of the foot area and the height of the lip area is greater than that of the foot area, whereby the lip area has a rounded-off top at its end facing away from the foot area. The slant of the lip area towards the outside away from the center of the plug connector part as well as the geometrical relationships of the foot area and the lip area facilitate the placement of the sealing lip onto the collar when the plug connector part is in its installed state in the recess of the partition wall. Between the foot area and the lip area, the outer circumference of the sealing lip forms an indentation that has a positive effect on the ability of the sealing lip to make contact with the partition wall. The indentation reinforces the tendency of the sealing lip to fold outwards upon contact with the partition wall. The foot area also imparts the sealing lip with the requisite stability and serves to anchor the sealing lip onto the collar of the base.

Moreover, it has proven to be advantageous for the second sealing element to have an insertion cone and a cylindrical section. The cylindrical section can have a diameter that, at the maximum, is equal to the outer diameter of a cable that is to be inserted. This geometrical relationship ensures a proper sealing effect of the second sealing element vis-à-vis a cable that is to be inserted. The insertion cone here makes it easier to insert the cable.

In another embodiment, each cable insertion opening in the second sealing element is closed by a membrane. In this context, the membrane is configured in such a way that it can be easily punctured by a cable while the latter is being inserted. On the other hand, the membrane seals off the cable insertion opening if the plug connector part has several cable insertion openings and, in a concrete application case, if not every cable insertion opening is occupied by a cable. The membrane is advantageously made of the same material as the second sealing element, so that the membrane can be manufactured together with the second sealing element in a single work step.

Moreover, it has proven to be advantageous for the third sealing element to close off the insulation-displacement contact bushing through the base of the plug connector part. For this purpose, the wall thickness of the third sealing element is of such a magnitude that, although an insulation-displacement contact can penetrate the wall of the base and can also project beyond it, it cannot project beyond the thickness of the third sealing element. This closure constitutes a simple and effective sealing technique.

It has also proven to be advantageous if the first, second and third sealing elements are made of a thermoplastic elastomer. Thermoplastic elastomers display good sealing properties and are easy to process.

In one embodiment, the base is made of a polyamide. Polyamides display good strength and, at the same time, are relatively easy to process. Moreover, they exhibit good insulating properties vis-à-vis electric current. They also easily bond with thermoplastic elastomers. In one advantageous embodiment, the polyamide is fiberglass-reinforced. For instance, a polyamide 6 or polyamide 66 containing 25%, 35% or 50% fiberglass can be used.

A method according to the invention for the manufacture of a plug connector part according to one of the preceding claims is characterized in that the plug connector part is produced by means of the two-component injection molding process. For example, first the base is produced as a preform, whereby the injection-molding tool is configured as a rotary tool, whereby, after the preform has been injection-molded, a tool part is rotated around its own axis by, for instance, 180°, thus changing the cavity for the subsequent injection-molding of the second component made of the thermoplastic elastomer. This method variant makes use of a two-component injection-molding machine having two injection-molding aggregates. In an alternative method, two injection-molding machines that each have an injection-molding tool can be linked to each other, whereby the preform is injection-molded in the first machine and it is then placed into the tool of the second machine and subsequently encapsulated with the soft component.

Other advantages, special features and practical refinements of the invention ensue from the subordinate claims and from the description below of preferred embodiments on the basis of figures.

Figure 2:
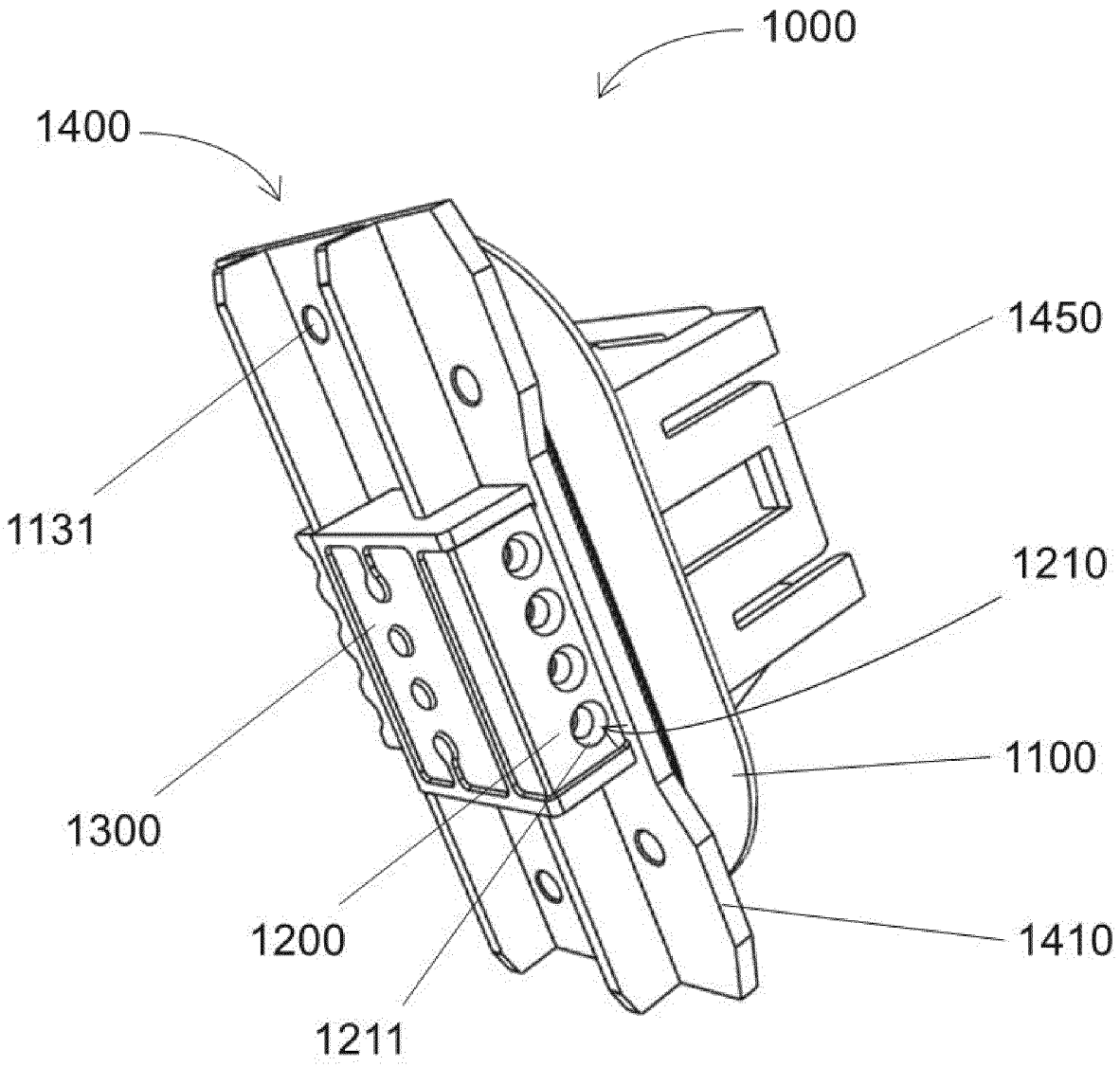
Figure 3:
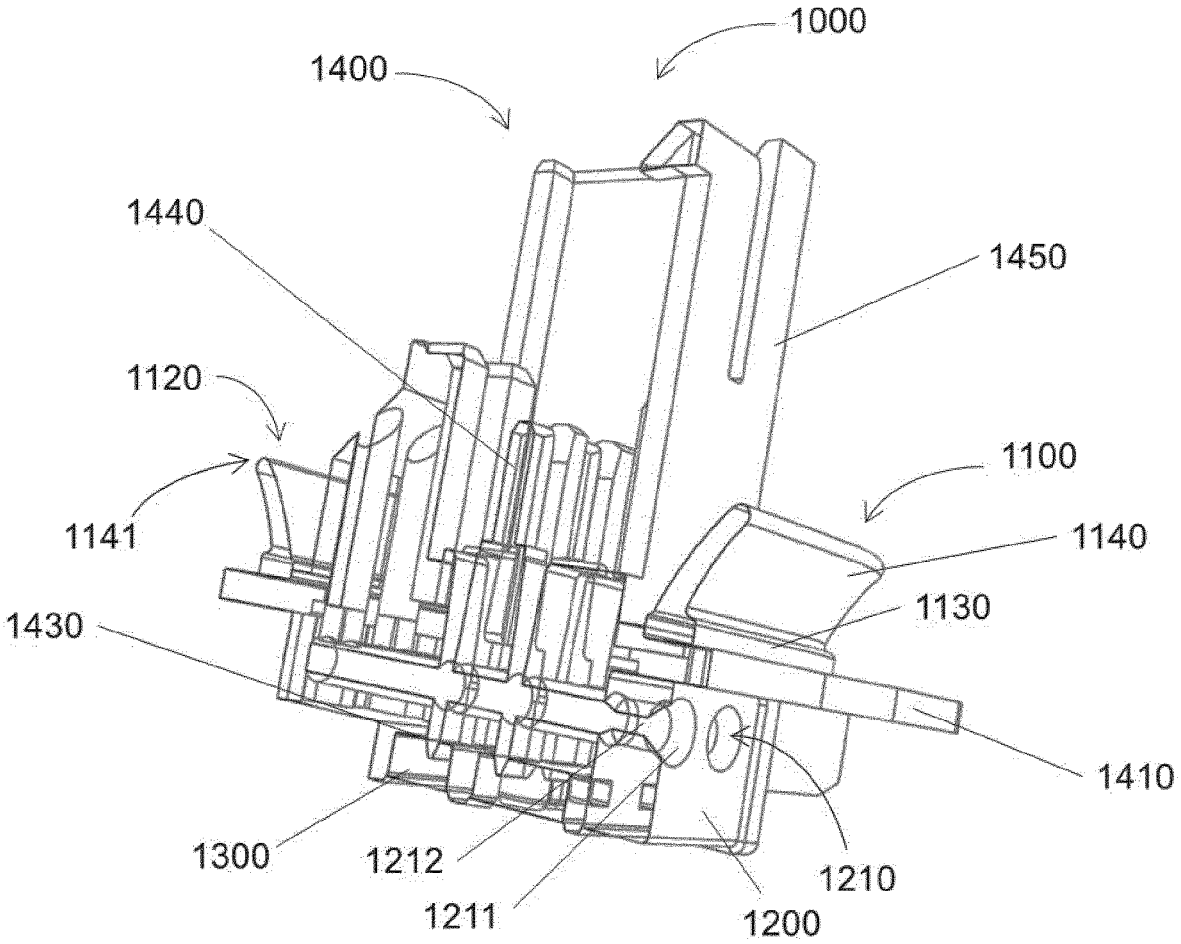
Figure 4:
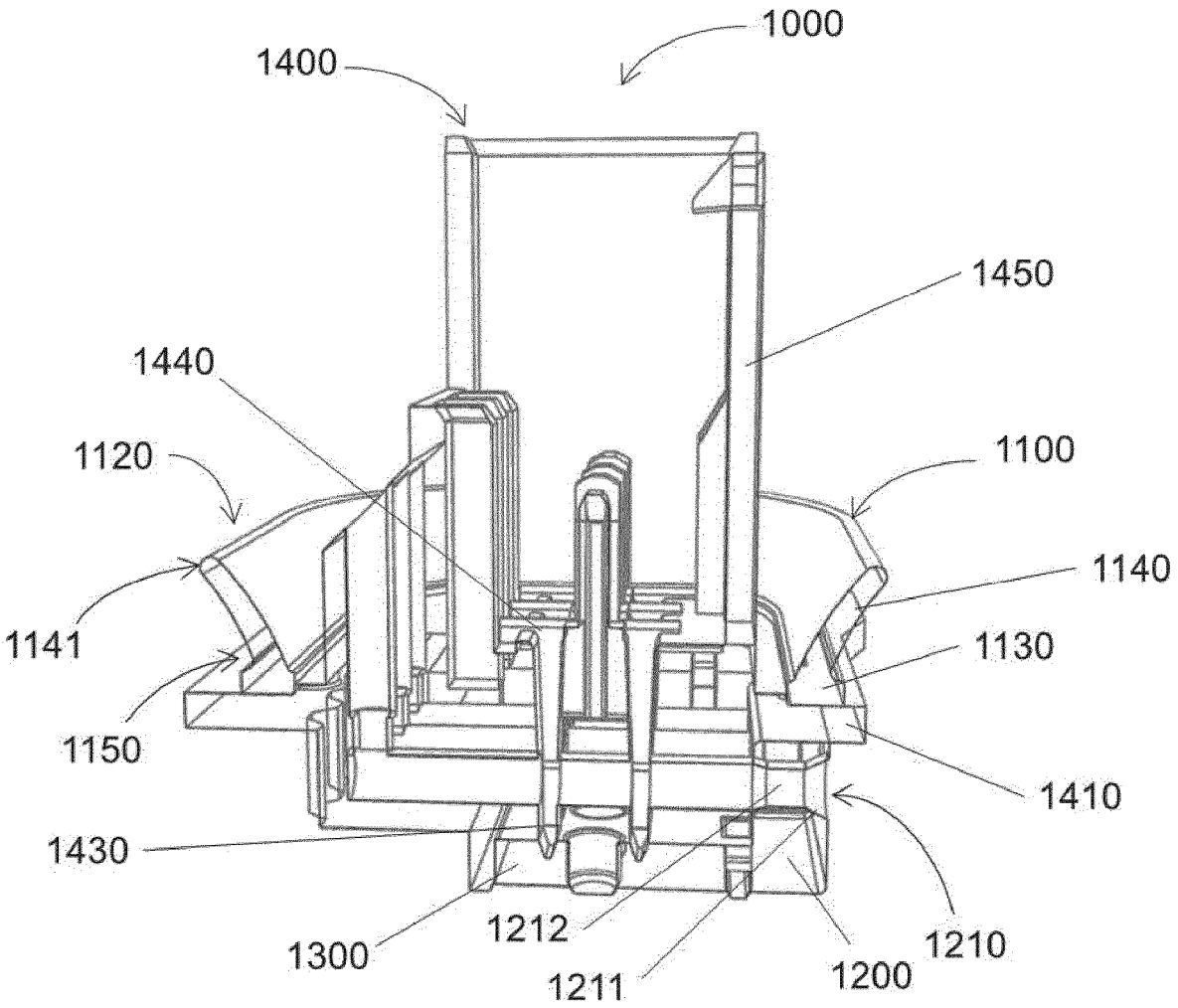
Figure 5:
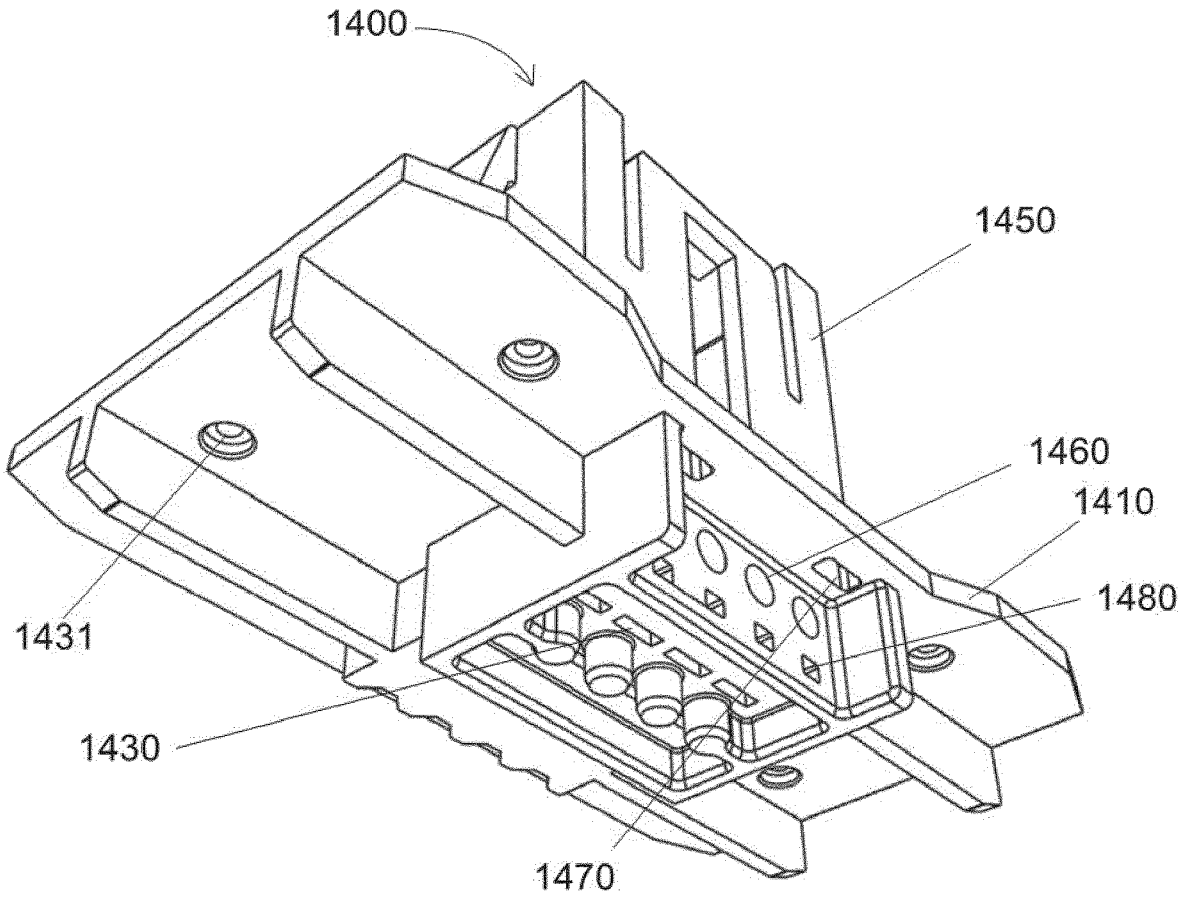
Figure 6:
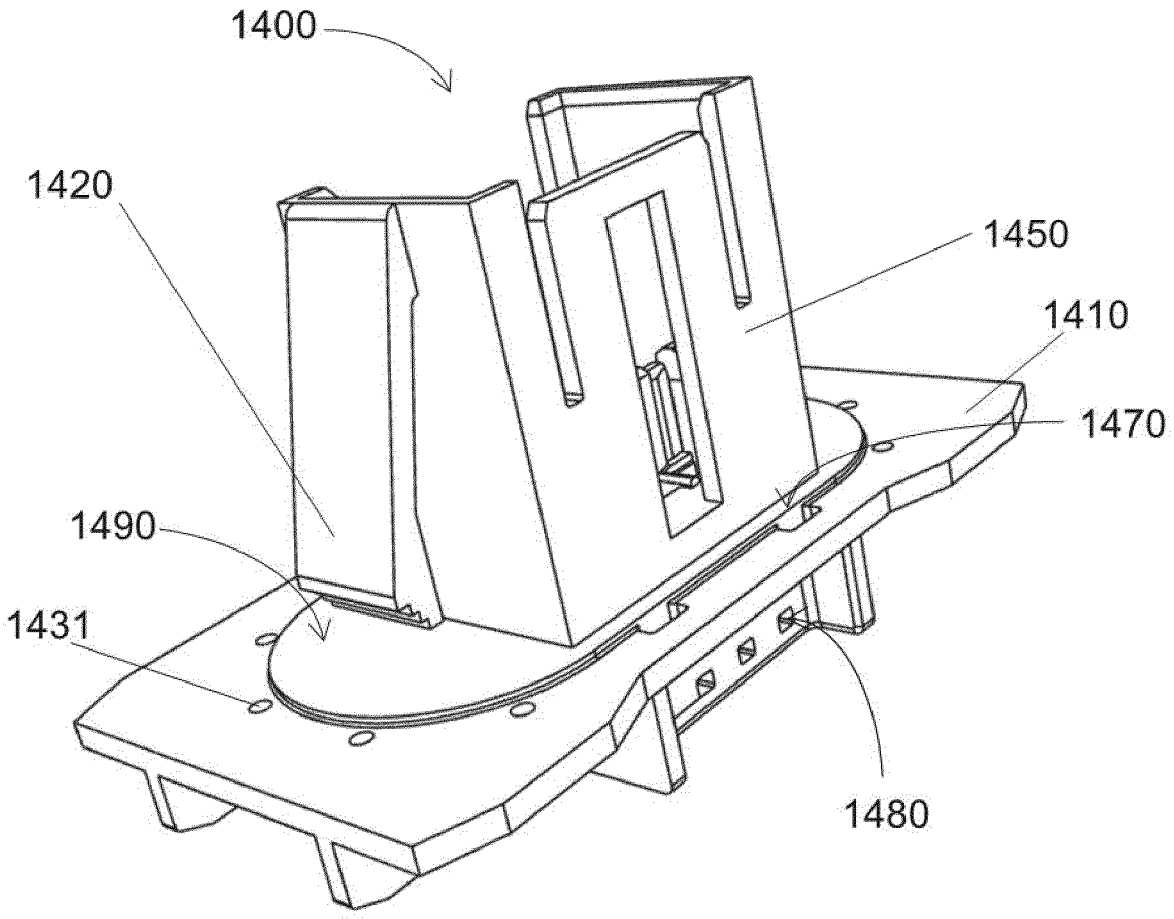
Figure 7:
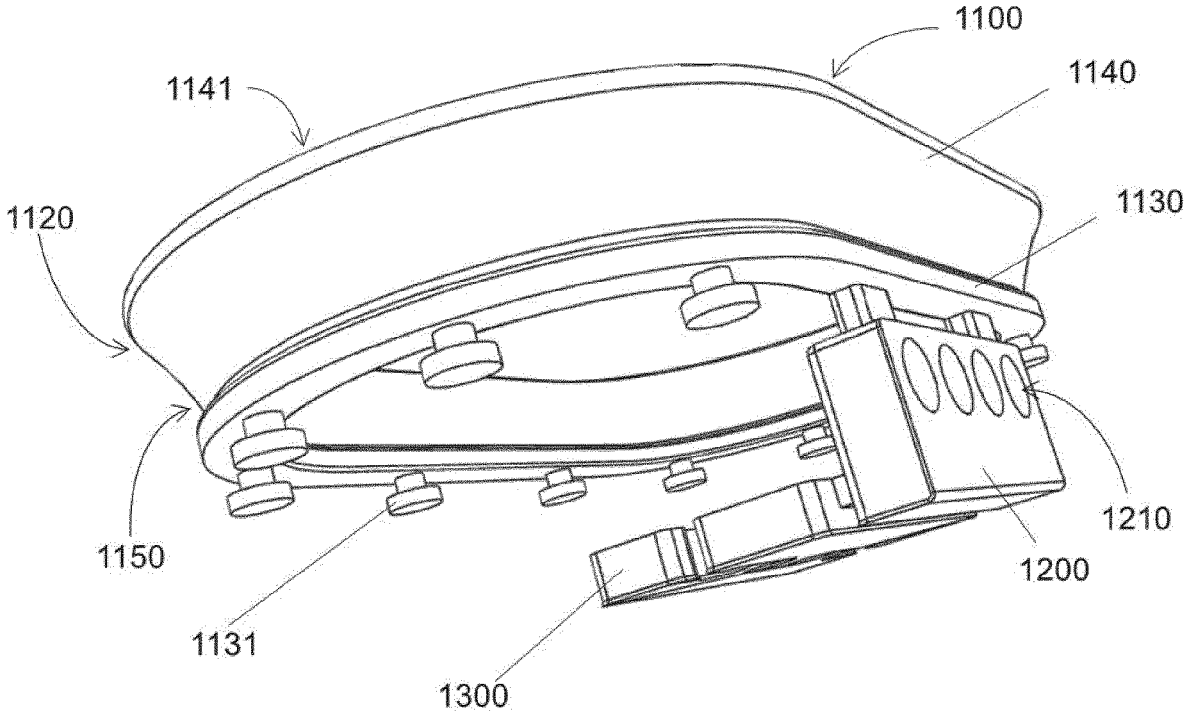

The figures show the following:

FIG. 1 a plug connector part according to the invention, in a three-dimensional view;

FIG. 2 a plug connector part according to the invention, in another three-dimensional view;

FIG. 3 a plug connector part according to the invention, in a cutaway three-dimensional view;

FIG. 4 a plug connector part according to the invention, in another cutaway three-dimensional view;

FIG. 5 the base of a plug connector part according to the invention, in a three-dimensional view;

FIG. 6 the base of a plug connector part according to the invention, in another three-dimensional view;

FIG. 7 a first, second and third sealing element of a plug connector part according to the invention, in a three-dimensional view.

FIG. 1 shows a plug connector part 1000 according to the invention, in a three-dimensional view. The plug connector part has a base 1400 made of a hard thermoplastic, for example, a PA 66 containing 25% fiberglass. The base 1400 has a housing-shaped projecting part 1450 in whose interior the contacting modalities in the form of insulation-displacement contacts 1440 can be seen for several cables that are to be connected. Moreover, the housing-shaped projecting part 1450 has guide means and latching means for a mating part of the plug connector part 1000. The housing-shaped projecting part 1450 of the base 1400 rests on a collar 1410 and, on its narrow sides, it has latching tabs 1420 with which the plug connector part 1000 can be affixed in a recess of a partition wall once it has been inserted into the recess. Moreover, a first sealing element 1100 can be seen which, in the form of a sealing lip, is arranged on the collar 1410 and encircles the housing-shaped projecting part.

FIG. 2 shows a plug connector part 1000 according to the invention, in another three-dimensional view at a slant from below. This view likewise shows the base 1400 as well as the housing-shaped projecting part 1450 with the guide means and latching means for a mating part of the plug connector part 1000. Moreover, the first sealing element 1100 is also shown. This first sealing element 1100 passes through the collar 1410 at several points and forms undercuts 1131 on the underside of the collar 1410 that serve to securely fasten the first sealing element 1100 on the collar 1410. The second sealing element 1200 with four cable insertion openings 1210 is also shown, whereby each of these cable insertion openings 1210 has an insertion cone 1211 at the exit plane out of the second sealing element 1200. The third sealing element 1300, which closes off the underside of the housing-shaped projecting part 1450, is shown on the underside of the plug connector part 1000.

FIG. 3 shows a plug connector part 1000 according to the invention, in a cutaway three-dimensional view. The cutaway view clearly shows the foot area 1130 and the lip area 1140 of the first sealing element 1100. The lip area 1140 has the cross section of a column that slants away from the center of the plug connector part 1000. The foot area 1130, in contrast, has a rectangular cross section. The wall of the lip area 1140 is thinner than that of the foot area 1130 and the height of the lip area 1140 is greater than that of the foot area 1130. The slant of the lip area 1140 towards the outside away from the center of the plug connector part 1000 as well as the geometrical relationships of the foot area 1130 and lip area 1140 facilitate the placement of the sealing lip 1120 onto the collar 1410 when the plug connector part 1000 is in its installed state in the recess of the partition wall. The foot area 1130 also imparts the sealing lip 1120 with the requisite stability and serves to anchor the sealing lip 1120 onto the collar 1410 of the base 1400. The lip area 1140 has a rounded-off top 1141 at its end facing away from the foot area 1130. The rounded-off top 1141 improves the sealing action of the sealing lip 1120 vis-à-vis the partition wall, especially when the plug connector part 1000 is not completely inserted into the recess of the partition wall.

Moreover, the cutaway view shows the insulation-displacement contact bushing 1430 through the base 1400. The third sealing element 1300 closes off this wall opening through the base 1400 vis-à-vis the surroundings, so that here, too, no insulating material such as, for instance, polyurethane can penetrate into the plug connector part. For this purpose, the wall thickness of the third sealing element is of such a magnitude that, although an insulation-displacement contact can penetrate the wall of the base and also project beyond it, it cannot project beyond the wall thickness of the third sealing element.

Moreover, FIG. 3 shows a cutaway view of the cable insertion opening 1210 in the second sealing element 1200. The cable insertion opening 1210 has an insertion cone 1211 and a cylindrical section 1212. The cylindrical section 1212 has a diameter that is equal to or smaller than the outer diameter of a cable that is to be inserted. This geometrical relationship ensures a proper sealing effect of the second sealing element 1200 vis-à-vis a cable that is to be inserted. The insertion cone 1211 here serves to facilitate the insertion of the cable. Each cable insertion opening 1210 in the second sealing element 1200 can be closed by a membrane (not shown here). In this context, the membrane is configured in such a way that it can be easily punctured by a cable while the latter is being inserted. On the other hand, the membrane seals off the cable insertion opening 1210 if the plug connector part 1000 has several cable insertion openings 1210 and, in a concrete application case, if not every cable insertion opening 1210 is occupied by cables. The membrane is advantageously made of the same material as the second sealing element 1200, so that the membrane can be manufactured together with the second sealing element 1200 in a single work step.

FIG. 4 shows a plug connector part 1000 according to the invention, in another cutaway three-dimensional view, whereby this view is slanted at a different angle from the one shown in FIG. 3. This cutaway view clearly shows the foot area 1130 and the lip area 1140 of the first sealing element 1100; in particular, the cross-sectional shape of the lip area 1140 of a column that slants away from the center of the plug connector part 1000 can be clearly seen here. Between the foot area 1130 and the lip area 1140, the outer circumference of the sealing lip 1120 forms an indentation 1150 that has a positive effect on the ability of the sealing lip 1120 to make contact with the partition wall.

FIG. 5 shows the base 1400 of a plug connector part 1000 according to the invention, in a three-dimensional view, whereby the first, second and third sealing elements 1100, 1200, 1300 are not yet present. The plug connector part is produced by means of the two-component injection molding process. First of all, the base 1400 is produced as a preform. In a second step, the base 1400 is encapsulated with the soft component, a process in which the first, second and third sealing elements 1100, 1200, 1300 are injection-molded onto the base 1400. The first, second and third sealing elements 1100, 1200, 1300 are integrally bonded to each other. As a result, only one of the sealing elements 1100, 1200, 1300 has to be connected with the sprue. The other two sealing elements 1100, 1200, 1300 are each joined to the melt flow by means of the joined sealing element 1100, 1200, 1300. For this purpose, the base 1400 has first flow openings 1470 as well as second flow openings 1480, whereby the first flow openings 1470 allow the melt to flow through between the first sealing element 1100 and the second sealing element 1200, while the second flow openings 1480 allow the melt to flow through between the second sealing element 1200 and the third sealing element 1300. Moreover, the base 1400 has wall openings 1460 through which the cables leading to the insulation-displacement contacts can pass.

FIG. 6 shows the base 1400 of a plug connector part 1000 according to the invention, in another three-dimensional view without the first, second and third sealing elements 1100, 1200, 1300. This view clearly shows the first flow openings 1470 as well as the second flow openings 1480. Moreover, the collar 1410 of the base 1400 has an area 1490 where the wall is thicker and whose outer contour matches the inner contour of the first sealing element 1100. Like the openings 1431, this serves to provide stability and a reliable anchoring of the first sealing element 1100 onto the collar 1410.

FIG. 7 shows the first, second and third sealing elements 1100, 1200, 1300 of a plug connector part 1000 according to the invention, in a three-dimensional view without the base 1400. Between the foot area 1130 and the lip area 1140, the outer circumference of the sealing lip 1120 forms an indentation 1150 that has a positive effect on the ability of the sealing lip 1120 to make contact with the partition wall. This view clearly shows the places where the second sealing element 1200 is joined to the first sealing element 1110 and to the third sealing element 1300. The undercuts 1131 of the first sealing element 1100 by means of which the first sealing element is anchored onto the collar 1410 are clearly visible.

The embodiments shown here constitute merely examples of the present invention and consequently must not be construed as being of a limiting nature. Alternative embodiments taken into consideration by the person skilled in the art are likewise encompassed by the protective scope of the present invention.

LIST OF REFERENCE NUMERALS

1000 plug connector part
1100 first sealing element
1110 latching
1120 sealing lip
1130 foot area
1131 undercut
1140 lip area
1141 rounded-off top
1150 indentation
1200 second sealing element
1210 cable insertion opening
1211 insertion cone
1212 cylindrical section
1300 third sealing element
1400 base
1410 collar
1420 latching tab
1430 bushing of the insulation-displacement contact

1431 opening
1440 insulation-displacement contact
1450 housing-shaped projecting part
1460 wall opening
1470 first flow opening
1480 second flow opening
1490 area with a thicker wall

The invention claimed is:

1. A plug connector part that can be inserted into a recess in a partition wall for connection to a mating part comprising:

a base with a collar, the collar projecting beyond a surface of the recess in the partition wall;

a first sealing element comprised of an encircling sealing lip on a side of the collar facing the partition wall, the first sealing element resting on the partition wall when the plug connector part is inserted into the recess of the partition wall;

a second sealing element comprised of a cable entry seal;

a bushing for an insulation-displacement contact; and a third sealing element comprised of a bushing seal, the third sealing element being integrally bonded to the first sealing element and to the second sealing element.

2. The plug connector part according to claim 1, wherein the first sealing element and the second sealing element are integrally bonded to each other.

3. The plug connector part according to claim 1, wherein the base is made of a polyamide.

4. A method for the manufacture of a plug connector part according to claim 1, wherein the plug connector part is produced by means of the two-component injection molding process.

* * * * *